US009475684B2

(12) United States Patent
Monzel

(10) Patent No.: US 9,475,684 B2
(45) Date of Patent: Oct. 25, 2016

(54) CONTAINER, AND METHOD FOR FILLING A CONTAINER

(75) Inventor: Alois Monzel, Mörstadt (DE)

(73) Assignee: KHS GmbH, Dortmund (DE)

( * ) Notice: Subject to any disclaimer, the term of this patent is extended or adjusted under 35 U.S.C. 154(b) by 574 days.

(21) Appl. No.: 13/121,993

(22) PCT Filed: Nov. 11, 2009

(86) PCT No.: PCT/EP2009/008036

§ 371 (c)(1),
(2), (4) Date: Mar. 31, 2011

(87) PCT Pub. No.: WO2010/054803

PCT Pub. Date: May 20, 2010

(65) Prior Publication Data

US 2011/0180569 A1 Jul. 28, 2011

(30) Foreign Application Priority Data

Nov. 11, 2008 (DE) ..... 10 2008 056 813

(51) Int. Cl.
*B65D 83/00* (2006.01)
*B67D 1/08* (2006.01)
*B67C 3/30* (2006.01)

(52) U.S. Cl.
CPC ..... *B67D 1/0832* (2013.01); *B67C 3/30* (2013.01); *B67D 1/0831* (2013.01)

(58) Field of Classification Search
CPC B67D 1/0832; B67D 1/0831; B67D 1/0835; B67C 3/30; B65D 47/24; B65D 47/245; B65D 47/247
USPC ..... 222/400.7, 147, 54, 61, 66, 148, 399, 222/153.12, 559–561, 542, 153.11, 402.14; 137/212; 156/86; 141/2, 348–350, 249, 141/366, 389
See application file for complete search history.

(56) References Cited

U.S. PATENT DOCUMENTS 964,615 A * 7/1910 Cordley ..... F16K 27/02 222/559
1,643,285 A * 9/1927 Davis ..... B65D 47/247 222/421
2,059,684 A * 11/1936 Feld ..... B67D 3/04 217/99
2,530,092 A 11/1950 Smye
3,866,626 A * 2/1975 Johnston ..... B67D 1/0831 137/322
3,933,282 A * 1/1976 Stevens, Jr. ..... 222/400.7
4,529,105 A * 7/1985 Lewins ..... 222/153.09
4,548,343 A * 10/1985 Gotch ..... 222/400.7
4,685,598 A * 8/1987 Nezworski ..... 222/400.7

(Continued)

FOREIGN PATENT DOCUMENTS

DE 10138365 2/2003
DE 102006034638 1/2008

(Continued)

*Primary Examiner* — J. Casimer Jacyna
(74) *Attorney, Agent, or Firm* — Occhiuti & Rohlicek LLP

(57) ABSTRACT

The present invention relates to a container, in particular a large-volume disposable container, for example a keg (1) for accommodating liquids, in particular for accommodating drinks, and to an associated method for filling such a container. The container is provided with a connection fitting (2) with seal (3). Upon delivery of the container, the connection fitting (2) and/or the seal (3) define/defines a passage (8) which is closed when the container is dispatched.

24 Claims, 1 Drawing Sheet

(56) References Cited

U.S. PATENT DOCUMENTS

| | | | | |
|---|---|---|---|---|
| 4,834,266 | A * | 5/1989 | Brewer et al. | 222/147 |
| 5,094,365 | A * | 3/1992 | Dorfman | 222/400.7 |
| 5,242,092 | A * | 9/1993 | Riis et al. | 222/400.7 |
| 5,511,692 | A * | 4/1996 | Willingham | 222/1 |
| 5,653,253 | A * | 8/1997 | Larsen | 137/315.01 |
| 6,089,415 | A * | 7/2000 | Terpstra et al. | 222/397 |
| 6,109,485 | A * | 8/2000 | Amidzich | 222/400.7 |
| 6,286,730 | B1 * | 9/2001 | Amidzich | 222/400.7 |
| 6,308,869 | B1 * | 10/2001 | Simpson | 222/400.7 |
| 6,932,238 | B2 * | 8/2005 | Baker | 222/1 |
| 7,080,760 | B2 | 7/2006 | Yu | |
| 7,546,935 | B2 * | 6/2009 | Wheaton | 222/400.7 |
| 7,604,147 | B2 * | 10/2009 | Anderson | 222/400.7 |
| 7,621,425 | B2 * | 11/2009 | Mathew | 222/212 |
| 8,261,765 | B2 * | 9/2012 | Wauters et al. | 137/212 |
| 8,714,395 | B2 * | 5/2014 | Monzel | 220/367.1 |
| 2006/0049215 | A1 | 3/2006 | Lim et al. | |
| 2008/0017671 | A1 | 1/2008 | Shieh et al. | |
| 2009/0206505 | A1 | 8/2009 | Monzel et al. | |
| 2009/0320264 | A1 * | 12/2009 | Berger et al. | 29/428 |
| 2010/0102087 | A1 * | 4/2010 | Meike et al. | 222/105 |
| 2010/0116356 | A1 * | 5/2010 | Wauters | 137/317 |
| 2010/0320238 | A1 * | 12/2010 | Poulsen | 222/400.7 |

FOREIGN PATENT DOCUMENTS

| | | |
|---|---|---|
| DE | 102007025286 | 12/2008 |
| FR | 2552401 | 3/1985 |
| GB | 1577119 | 10/1980 |
| WO | 00/03944 | 1/2000 |
| WO | 2007/064227 | 6/2007 |
| WO | 2008/083782 | 7/2008 |

* cited by examiner

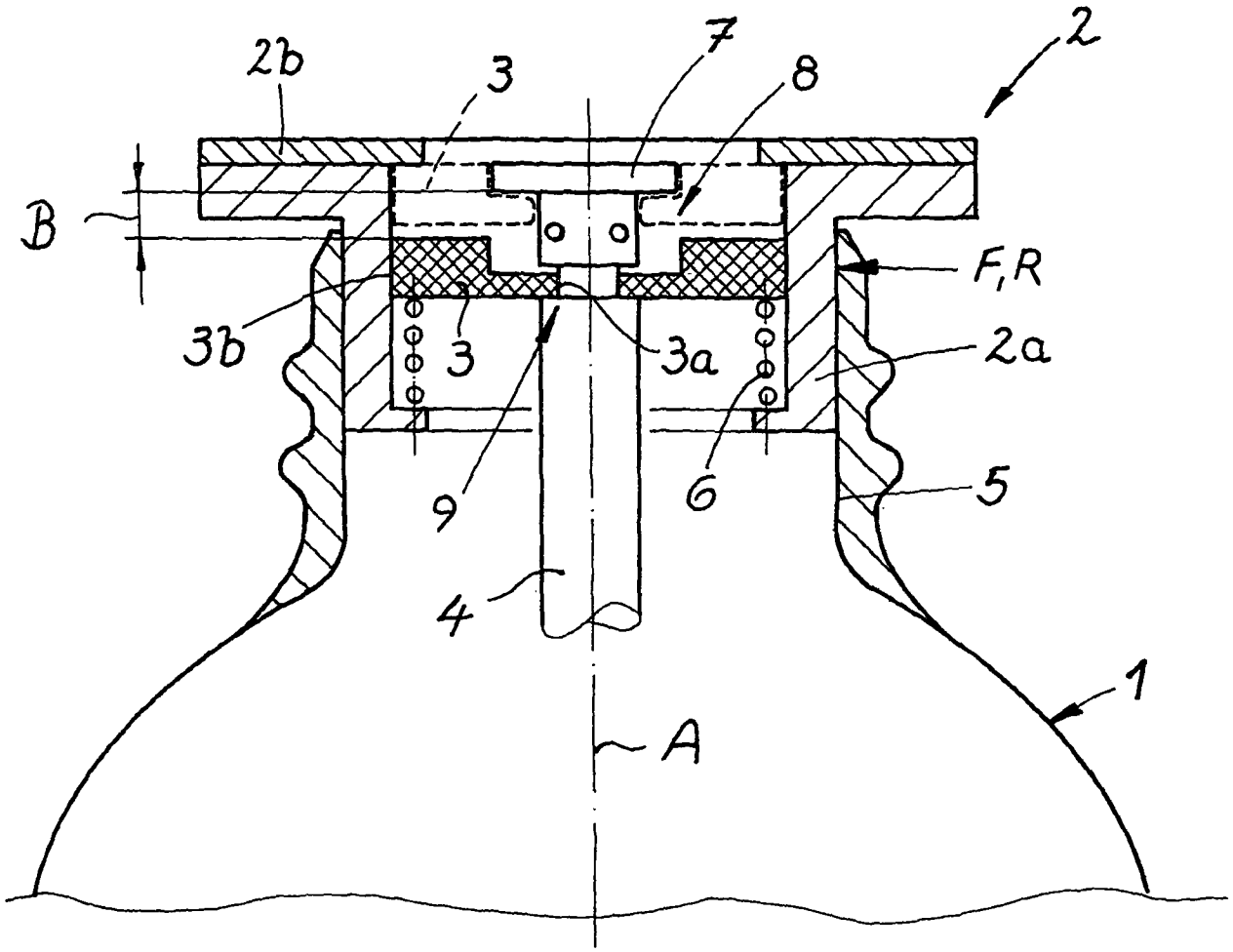
2
F,R
2a
5
1
8
7
6
3a
A
3
3
9
4
2b
3b
B

CONTAINER, AND METHOD FOR FILLING A CONTAINER

CROSS-REFERENCE TO RELATED APPLICATIONS

This application is the National Stage of International Application No. PCT/EP2009/008036, filed on Nov. 11, 2009, which claims the benefit of the Nov. 11, 2007 priority of German Patent Application No. 10 2008 056 813.9. The contents of both applications are hereby incorporated by reference in their entirety.

FIELD OF INVENTION

The invention relates to a large-volume disposable plastic keg, and in particular, to a keg having a connection fitting with seal.

BACKGROUND

Containers with connection fittings are known from, for example, WO 2008/083782 A2, DE 101 38 365 A1, and DE 10 2006 034 638 A1.

Large-volume containers that hold more than 10 liters, and in particular 30 liters or 50 liters, are generally used to store a liquid, such as beer, and to dispense that liquid under pressure. Among these are special large-volume containers called "kegs." Kegs are typically returnable vessels that have been developed for the industrial filling and sterile storage of beverages.

As a rule, a keg has a valve on its top side. This valve is sometimes called a "keg head." A suitable tap head can be mounted on the keg head. The tap head supplies a propellant gas from an external container into the keg. A suitable propellant gas is carbon dioxide or nitrogen. The propellant gas, once in the keg, generates an overpressure in the interior of the keg. This overpressure ensures that the liquid stored in the keg can be removed via a rising pipe and a tap dispenser. The tap head seals the container tightly such that the liquid stored therein remains sterile.

The overpressure created by the propellant gas in the keg permits beverage to be pushed out through the rising pipe from the interior of the keg upon opening a tap cock. Closing the tap cock closes the valve, which in turn closes the keg. In this state, the keg is airtight, and further storage of the content is possible. Closing the valve also prevents any residue from drying up and maintains overpressure in the keg.

Two problems arise in connection with kegs. The first relates to filling the keg, and the second relates to cleaning the connection fitting.

Usually, one fills a keg with the connection fitting already mounted in the neck. In most cases, the connection fitting has a fitting body and an abutment for a seal. When the connection fitting is in the container neck, the opening available for filling is much narrower. This results in turbulence as the liquid product flows into the container. Depending on the character of the liquid product, such turbulence can lead to foam formation. To avoid excess foaming, one must reduce flow rate. Reducing flow rate, however, reduces filling speed.

Known connection fittings are closed when they are delivered to a bottling plant. This makes them difficult to clean. In particular, there is a risk of dirt accumulation in the region of the closed sealing faces. This accumulated dirt only be removed, if at all, in a very expensive manner.

SUMMARY

The technical problem underlying the invention is to develop a container having a connection fitting that is easy to clean, and a method for filling such a container.

To solve this technical problem, a connection fitting for a container has a delivery state, in which a passage out of the container is open, and a dispatch state, in which the passage is closed. The container is typically a large-volume disposable plastic container.

According to the invention, a difference between a delivery state of the connection fitting and a dispatch state of the connection fitting arises from a difference in the configuration of the seal. In contrast, in the prior art, the connection fitting is delivered closed and connected to the container.

The connection fitting has a passage in the delivery state. This ensures that the connection fitting can be cleaned without difficulty while it is in the delivery state. The passage makes it possible to easily clean and disinfect the connection fitting, and in particular, those parts of the seal that are inaccessible when the connection fitting is in the dispatch state.

It is also possible to fill the container without the connection fitting being mounted. As a result, the entire cross section of the container neck is available during filling. This permits increased in the filling speed through the enlarged filling cross section. An additional benefit is that turbulence is either eliminated or reduced far below that encountered in the state of the art.

The connection fitting is generally not inserted into the container neck until the container has been completely filled. In this case the connection fitting, in the delivery state, ensures that any overpressure created in the container during filling escapes easily through the passage. Not until the connection fitting has been inserted into the filled container or its container neck does the connection fitting actually transition into the dispatch state. Once the connection fitting is in the dispatch state, the passage is closed and no liquid in the container can escape.

According to the invention, the connection fitting is not connected to the container neck until the filling operation has been completed. Upon completion of the filling operation, the connection fitting and/or the seal transitions into the dispatch state. This occurs through the simultaneous closing of one or more passages. A force, such as a radially acting force, on the container neck, triggers the transition.

The transition from the delivery state to the dispatch state is accomplished by exertion of a force on the connection fitting, or more precisely in the region near the seal. Preferably, this force is in the radial direction. Prior to application of this force, the seal maintains itself in the delivery position. It does so by being locked relative to the connection fitting. In contrast, in the dispatch state, the seal is not locked to the connection fitting, and is therefore free to move within it.

In the delivery state, the seal is detached or spaced from an associated sealing surface in or on the connection fitting. In the dispatch state, the seal abuts against the sealing surface or sealing surfaces and the connection fitting.

In some embodiments, the invention features a snap-in holder for locking the seal. The snap-in holder can be a recess in the connection fitting or in a rising pipe. In the delivery state, the seal engages this recess.

In one embodiment, the seal's inner ring surface engages a recess that completely or partially surrounds the rising pipe. A closing spring exerts a force on the seal.

In other embodiments, the seal is held in the detached position on the rising pipe by a protruding nose or in the interior of the connection fitting.

A seal that is held by its inner ring surface in a ring-shaped recess or in an annular groove in a rising pipe remains held in the delivery state against the force of the closing spring. This defines a passage. In one embodiment, the passage includes at least one annular gap that is formed between the inner ring surface of the seal and/or its outer ring surface and the associated rising pipe or a fitting body. While the connection fitting is in its delivery state, any gas causing overpressure can escape through the passage or through the annular gap after the container is filled and/or after the connection fitting is inserted. Then, the seal is made to transition into its dispatch position.

In some embodiments, the connection fitting experiences an application of a radial force that changes the diameter of the connection fitting or the diameter of its fitting body. This change can be a reduction or an enlargement. In both cases the application of a radial force ensures that the seal is no longer held by its inner ring surface within the annular groove in the rising pipe. When this is the case, the seal can be placed against the sealing surfaces by the force of the closing spring.

In some embodiments, the rising pipe experiences an axially directed force that causes the inner ring surface of the seal to detach from the annular groove. This causes the seal to transition into its dispatch position, in which the passage is closed.

The change from the delivery state to the dispatch state can be carried out in other ways. In general, the transition includes having the connection fitting and/or the seal assume a locking position or another type of temporary position in which a passage is defined. This is the delivery state. To transition into the dispatch state, this temporary position or locking position is mechanically lifted, or disrupted. This typically occurs concurrently with fixing the connection fitting to the container neck. However, the transition does not need to be concurrent with fixing the connection fitting to the neck.

The container and its associated filling method as described herein enable the filling speed to be increased while reducing the risk of the permanent accumulation of dirt on the connection fitting.

BRIEF DESCRIPTION OF THE FIGURES

The invention is described in more detail below by way of a drawing representing just one exemplary embodiment. The single FIGURE shows a container according to the invention in the region of its container neck.

DETAILED DESCRIPTION

The FIGURE shows an apparatus having a plastic keg 1. Such a keg 1 is used as a disposable container for accommodating beverages, for example beer. Once the keg 1 has been emptied, its volume can be reduced or it can be compressed and recycled. A suitable plastic from which a keg 1 can be made is PET (polyethylene terephthalate).

The keg 1 has a connection fitting 2 with a seal 3. The apparatus also includes a rising pipe 4 through which liquid in the interior of the container 1 flows out under pressure.

The connection fitting 2 includes a fitting body 2*a* and an optional abutment 2*b*. The fitting body 2*a* is inserted into a neck 5 of the keg 1. In one embodiment the fitting body 2*a* is a ring-shaped flange having an L-shaped cross section. Once inserted, the connection fitting 2 as a whole, or the fitting body 2*a*, or more precisely the flange, is connected to the neck 5 of the keg 1 in a force-locking and/or form-locking manner, as explained in detail in WO 2008/083782 A2.

The fitting body or flange 2*a* acts as a supporting and abutting element for a closing spring 6. The spring's foot supports the spring 6 on the fitting body 2. The spring's head acts on the seal 3. In the closed position, as shown by the dashed lines, the spring 6 urges the seal 3 to abut against an abutment 7 at the head of the rising pipe 4 and against sealing surfaces formed at that location.

In the example shown, the rising pipe 4 is arranged in a fixed manner in the keg 1. But in some embodiments, the rising pipe 4 is movable in the axial direction.

The connection fitting 2 has two states: a delivery state, and a dispatch state. A continuous line in the FIGURE represents the delivery state of the connection fitting 2. When a connection fitting 2 is in the delivery state, the seal 3 is in a delivery position.

A broken line in the FIGURE represents the dispatch state of the connection fitting 2. When the connection fitting 2 is in the dispatch state, the seal 3 is in the dispatch position.

In the delivery state, the connection fitting 2, or more precisely, the seal 3, defines at least one passage 8. The passage 8 comprises one or more annular gaps. Any overpressure located in the keg 1 can escape through this passage.

Beneath the abutment 7 are first and second circular regions. In the delivery state shown, these circular regions are exposed to the exterior of the keg 1. In contrast, in the dispatch state, shown by the broken line, when the passage 8 is closed, the circular regions are not exposed to the exterior of the keg 1.

In the delivery position, the seal 3 is locked relative to the connection fitting 2. This means that even though the spring 6 urges the seal 3 upwards into the dispatch position, the seal 3 remains in the delivery position. A snap-in holder 9 urges the seal 3 to remain in the delivery position even though the spring 6 urges the seal 3 up into the dispatch position.

In the illustrated embodiment, the snap-in holder 9 comprises a recess or an annular groove. An inner-ring surface 3*a* of the seal 3 engages the snap-in holder 9. Meanwhile, an outer ring surface 3*b* of the seal 3 abuts against the fitting body 2*a*. The connection fitting 2, the seal 3, the rising pipe 4, the keg 1 and also the container neck 5 are rotationally symmetric about a common axis A. As a result, the seal 3 is shaped like a disk, with the inner ring surface 3*a* and the outer ring surface 3*b* forming the inner and outer peripheries of the disk.

As already pointed out, when the connection fitting 2 is in the delivery state, an inner ring surface 3*a* of the seal 3 engages the annular groove in the rising pipe 4. As a result, there is a space B between the seal 3 and the abutment 7. After filling the keg 1, the connection fitting 2, which is in the delivery state, is inserted into the container neck 5. As a result, any excess pressure above the filled liquid or the liquid product can easily be relieved, because the gas that causes the excess pressure can leave the keg 1 through the passage 8 that is defined while the connection fitting 2 is in the delivery state.

Once the gas that causes the overpressure has escaped from the keg's interior at the end of the filling operation, the connection fitting 2 is made to transition into the dispatch state. The transition to the dispatch state occurs by closing the passage 8.

In order to close the passage 8, a force F acting in the radial direction R is exerted on the fitting body 2*a*. As a result of this force F, the seal 3 deforms slightly. This deformation enables the seal's inner ring surface 3*a* to escape from the annular snap-in holder 9. For example, the inner ring surface 3*a* escapes from the annular groove that defines the snap-in holder 9.

With the seal 3 no longer restrained by the snap-in holder 9, and therefore no longer attached to the rising pipe 4, the closing spring 6 presses the seal 3 against the abutment 7. This places the connection fitting 2 into the dispatch state. In the dispatch state, the keg 1 is closed and the liquid located in the interior can no longer escape. The keg 1 can then be provided with a tap head in order to dispatch the liquid from the keg's interior.

Having described the invention, and a preferred embodiment thereof, what is claimed as new, and secured by Letters Patent is:

1. An apparatus comprising a keg, a seal, and a connection fitting, wherein said keg comprises an interior for holding a beverage, wherein said keg defines an axial direction, wherein said keg defines a radial direction, wherein said radial direction is perpendicular to said axial direction, wherein said seal is configured to transition between a sealed state and an unsealed state, wherein, when said seal is in said sealed state, said seal seals said keg, wherein, when said seal is in said unsealed state, said keg is unsealed, wherein said connection-fitting is disposed in a neck of said keg, wherein said connection-fitting defines a connection-fitting axis that is coaxial with said axial direction that is defined by said keg, wherein said connection-fitting engages said seal, wherein, when said seal is in said unsealed state, said seal remains in said unsealed state without application, to said keg, of any external force that is generated from outside of said keg, wherein, when said seal is in said sealed state, said seal remains in said sealed state without having to apply, to said keg, any external force that is generated from outside of said keg, wherein said seal is configured to automatically transition from said unsealed state to said sealed state at least in part in response to an external force that is generated from outside of said keg, and wherein said external force is applied to a wall of said keg, and a spring disposed to urge said seal into said sealed position.

2. The apparatus of claim 1, wherein said connection-fitting comprises a flange that extends radially inward towards said central axis of said connection fitting.

3. The apparatus of claim 1, wherein said seal comprises a seal surface, wherein said seal surface faces said interior of said keg, wherein said connection-fitting comprises a flange that extends radially inward towards a central axis of said connection fitting, wherein said flange defines a flange-surface, wherein said spring comprises a foot, wherein said foot of said spring rests on said flange-surface, wherein said spring comprises a head that is disposed on an opposite end of said spring from said foot, wherein said head of said spring engages said seal surface, wherein, as a result of said engagement of said head of said spring and said seal surface and said foot of said spring resting on said flange-surface, said spring applies a force to said seal, wherein said force applied by said spring biases said seal to move in a direction away from said interior of said keg, and wherein said force applied by said spring urges said seal to move in a direction parallel to said central axis of said connection fitting.

4. The apparatus of claim 1, wherein said seal transitions from said unsealed state to said sealed state upon application of an external force that is directed in said radial direction, wherein said radial direction is a direction that is parallel to a plane defined by said seal, wherein said radial direction is perpendicular to said axial direction defined by said keg.

5. The apparatus of claim 1, wherein said seal is configured to transition from being locked into said unsealed state to not being locked in said unsealed state in response to application of said external force that is generated from outside said keg and that is applied to said keg.

6. The apparatus of claim 1, further comprising a rising pipe, wherein said rising pipe comprises an annular groove formed therein, wherein, when seal is in said unsealed state, said annular groove engages said seal, and wherein, when said annular groove engages said seal, said seal remains in said unsealed state until application of said external force that is generated from outside said connection-fitting and that is applied to said connection-fitting to cause said seal and said annular groove to become disengaged so that said connection-fitting is able to transition into said sealed state.

7. The apparatus of claim 1, further comprising a recess in a surface of a pipe, said recess extending radially inward and having a size that accommodates said seal, wherein, when said seal is in said unsealed state, said recess engages said seal, and wherein, when said seal is transitioning into said sealed state, said recess releases said seal.

8. The apparatus of claim 1, wherein in said unsealed position, an inner peripheral surface of said seal engages an annular groove, and wherein application of said external force causes said inner peripheral surface to become disengaged from said annular groove.

9. The apparatus of claim 1, wherein said connection-fitting comprises a protrusion having an L-shaped cross-section, wherein said protrusion extends inward from an outer wall of said container fitting towards an axis of said connection-fitting.

10. An apparatus comprising a keg, a seal, and a connection fitting, wherein said keg comprises an interior for holding a beverage, wherein said keg defines an axial direction, wherein said keg defines a radial direction, wherein said radial direction is perpendicular to said axial direction, wherein said seal is configured to transition between a sealed state and an unsealed state, wherein, when said seal is in said sealed state, said seal seals said keg, wherein, when said seal is in said unsealed state, said keg is unsealed, wherein said connection-fitting is disposed in a neck of said keg, wherein said connection-fitting defines a connection-fitting axis that is coaxial with said axial direction that is defined by said keg, wherein said connection-fitting engages said seal, wherein, when said seal is in said unsealed state, said seal remains in said unsealed state without application, to said keg, of any external force that is generated from outside of said keg, wherein, when said seal is in said sealed state, said seal remains in said sealed state without having to apply, to said keg, any external force that is generated from outside of said keg, wherein said seal is configured to automatically transition from said unsealed state to said sealed state at least in part in response to an external force that is generated from outside of said keg, and wherein said external force is applied to a wall of said keg, and a snap-in holder, wherein said seal engages said snap-in holder when said seal is in said unsealed position, wherein, in response to said external force, said seal escapes engagement by said snap-in holder, thereby enabling said seal to transition into said sealed state.

11. The apparatus of claim 10, wherein engagement of said snap-in holder and said seal prevents a spring that is disposed to urge said seal into said sealed state from moving said seal into said sealed state.

12. The apparatus of claim 10, wherein said seal is disk shaped, wherein said seal has an inner peripheral surface and an outer peripheral surface, and wherein, when said seal is in said sealed state, said inner peripheral surface of said seal engages a recess.

13. The apparatus of claim 10, further comprising a spring, wherein said seal comprises a seal surface, wherein said seal surface faces said interior of said keg, wherein said connection-fitting comprises a flange that extends radially inward towards a central axis of said connection fitting, wherein said flange defines a flange-surface wherein said spring comprises a foot, wherein said foot of said spring rests on said flange-surface, wherein said spring comprises a head that is disposed on an opposite end of said spring from said foot, wherein said head of said spring engages said seal surface, wherein, as a result of said engagement of said head of said spring and said seal surface and said foot of said spring resting on said flange-surface, said spring applies a force to said seal, wherein said force applied by said spring biases said seal to move in a direction away from said interior of said keg, and wherein said force applied by said spring urges said seal to move in a direction parallel to said central axis of said connection fitting.

14. The apparatus of claim 10, wherein said seal is configured to transition from being locked into said unsealed state to not being locked in said unsealed state in response to application of said external force that is generated from outside said keg and that is applied to said keg.

15. The apparatus of claim 10, further comprising a recess in a surface of a pipe, said recess extending radially inward and having a size that accommodates said seal, wherein, when said seal is in said unsealed state, said recess engages said seal, and wherein, when said seal is transitioning into said sealed state, said recess releases said seal.

16. The apparatus of claim 10, wherein said connection-fitting comprises a protrusion having an L-shaped cross-section, wherein said protrusion extends inward from an outer wall of said container fitting towards an axis of said connection-fitting.

17. An apparatus comprising a keg, a seal, and a connection fitting, wherein said keg comprises an interior for holding a beverage, wherein said keg defines an axial direction, wherein said keg defines a radial direction, wherein said radial direction is perpendicular to said axial direction, wherein said seal is configured to transition between a sealed state and an unsealed state, wherein, when said seal is in said sealed state, said seal seals said keg, wherein, when said seal is in said unsealed state, said keg is unsealed, wherein said connection-fitting is disposed in a neck of said keg, wherein said connection-fitting defines a connection-fitting axis that is coaxial with said axial direction that is defined by said keg, wherein said connection-fitting engages said seal, wherein, when said seal is in said unsealed state, said seal remains in said unsealed state without application, to said keg, of any external force that is generated from outside of said keg, wherein, when said seal is in said sealed state, said seal remains in said sealed state without having to apply, to said keg, any external force that is generated from outside of said keg, wherein said seal is configured to automatically transition from said unsealed state to said sealed state at least in part in response to an external force that is generated from outside of said keg, and wherein said external force is applied to a wall of said keg, and a snap-in holder, wherein, while said seal remains in said unsealed state, said seal engages said snap-in holder.

18. The apparatus of claim 17, wherein said seal is configured to disengage from said snap-in holder in response to application of said external force that is generated from outside said keg and that is applied to said keg.

19. The apparatus of claim 17, wherein said connection-fitting comprises a flange that extends radially inward towards said central axis of said connection fitting.

20. The apparatus of claim 17, wherein said snap-in holder engages said seal, thereby preventing a spring that is disposed to urge said seal into said sealed state from moving said seal into said sealed state.

21. The apparatus of claim 17, wherein said seal transitions from said unsealed state to said sealed state upon application of an external force that is directed in said radial direction, wherein said radial direction is a direction that is parallel to a plane defined by said seal, wherein said radial direction is perpendicular to said axial direction defined by said keg.

22. The apparatus of claim 17, further comprising a rising pipe, wherein said rising pipe comprises an annular groove formed therein, wherein, when seal is in said unsealed state, said annular groove engages said seal, and wherein, when said annular groove engages said seal, said seal remains in said unsealed state until application of said external force that is generated from outside said connection-fitting and that is applied to said connection-fitting to cause said seal and said annular groove to become disengaged so that said connection-fitting is able to transition into said sealed state.

23. The apparatus of claim 17, wherein said seal is disk shaped, wherein said seal has an inner peripheral surface and an outer peripheral surface, and wherein, when said seal is in said sealed state, said inner peripheral surface of said seal engages a recess.

24. The apparatus of claim 17, wherein in said unsealed position, an inner peripheral surface of said seal engages an annular groove, and wherein application of said external force causes said inner peripheral surface to become disengaged from said annular groove.

* * * * *